US009057203B2

(12) United States Patent
Butterfield

(10) Patent No.: US 9,057,203 B2
(45) Date of Patent: Jun. 16, 2015

(54) SWIMMING POOL LANE LINE SUPPORT APPARATUS

(76) Inventor: Peter J. Butterfield, Kershaw, SC (US)

( * ) Notice: Subject to any disclaimer, the term of this patent is extended or adjusted under 35 U.S.C. 154(b) by 476 days.

(21) Appl. No.: 13/490,604

(22) Filed: Jun. 7, 2012

(65) Prior Publication Data

US 2012/0311776 A1 Dec. 13, 2012

Related U.S. Application Data

(60) Provisional application No. 61/495,464, filed on Jun. 10, 2011.

(51) Int. Cl.
*E04H 4/00* (2006.01)
*E04H 4/14* (2006.01)

(52) U.S. Cl.
CPC ..... *E04H 4/143* (2013.01)

(58) Field of Classification Search
CPC ..... E04H 4/1236
USPC ..... 4/488–513; 482/55
See application file for complete search history.

(56) References Cited

U.S. PATENT DOCUMENTS 4,953,239 A * 9/1990 Gadsby ..... 4/499
6,055,682 A * 5/2000 Sanchez ..... 4/496

* cited by examiner

*Primary Examiner* — Lori Baker

(57) ABSTRACT

A swimming pool lane line support apparatus includes a first end portion, defining a first guide member, a second end portion, defining a second guide member, and a central portion including a smooth, curved surface. The first guide member, second guide member and curved surface define a lane line channel adapted to support and contain a swimming pool lane line. Furthermore, the swimming pool lane line support apparatus is adapted to securely fit in a peripheral gutter system of a swimming pool.

24 Claims, 6 Drawing Sheets

SWIMMING POOL LANE LINE SUPPORT APPARATUS

CROSS-REFERENCE TO RELATED APPLICATION

The present application is a U.S. nonprovisional patent application of, and claims priority under 35 U.S.C. §119(e) to, U.S. provisional patent application Ser. No. 61/495,464, filed Jun. 10, 2011, which provisional patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to swimming pool accessories, and more particularly to an apparatus for supporting a swimming pool lane line.

Swimming pool lane lines are used in large swimming pools as a means to divide the pool into lanes for purposes including recreational lap swimming and competitive swimming events. Typical swimming pool lane lines are comprised of a rope or cable held near the surface of the water with a plurality of ring shaped disks and donut- to ovoid-shaped floats spaced along the length of the rope or cable. Most modern lane lines are designed to suppress wave turbulence.

Many swimming pool lane lines comprise a central cable on which buoyant spaced-apart rings, disks or cylinders, some having radially extending fins, are threaded. The rings, disks, fins, or other elements threaded on the supporting cable are generally made from plastic materials. Unfortunately, when in use, the plastic materials of the lane lines are exposed to chlorine compounds, salts, and/or radiation from the sun. These factors, over time, deteriorate the plastic eventually causing the plastic to become stiff and brittle.

The lane lines are generally extended into and retracted from the pool by either dragging the lines directly into or out of the pool by hand, or winding the lines on a reel located on the pool deck. Because of the length of the lane lines, use of a reel is often the preferred method of lane line storage and management. During such extending or retracting process, the edges or fins of the rings, disks, or cylinders of the lane line rub against the edge of the pool deck. If the edges or fins of the rings, disks, or cylinders of the lane line are hardened or stiffened, as typically occurs when exposed to chlorine compounds, salts and sunlight, such rubbing chips away at the brittle elements, thereby damaging the plastic rings. This damage reduces the efficacy of the lane lines, creates sharp edges that become a safety hazard to swimmers, and leaves broken pieces of plastic in the water that can be a further hazard to swimmers and/or foul the pool filtration system. Over time, the continued rubbing of the sharp or broken edges of the lane line may also actually damage the edge of the pool deck.

Examples of swimming pool lane line support devices can be found, for example, in U.S. Pat. No. 6,055,682 to Sanchez. In the '682 patent, the disclosed lane line protection device is positioned over the edge of a swimming pool and bypasses the sharp edge of the pool by creating a smooth surface over the pool's edge. A lane line is placed over the smooth surface of the device, thereby preventing the lane line from contacting the relatively sharp edge of the pool. Furthermore, the device of the '682 patent includes a U-shaped channel centrally located therein through which the lane line slides or glides as it transitions between the water and a storage reel or vice versa. The channel includes smooth edges that are sufficiently high to prevent the lane line from slipping or pulling out of the channel so long as the lane line is not pulled at an angle to the channel. Despite these advantages, the device of Sanchez has several drawbacks. First, the device does not include a mechanism to prevent unwanted movement. For instance, nothing prevents the device from sliding toward, and even into, the swimming pool. Second, the geometry of the device is not adapted for use in a swimming pool having a recessed peripheral gutter system. Third, the device can accommodate only one lane line at a time. Fourth, the device has a narrow channel with depth ratios insufficient to prevent the lane line from leaving the channel when the lane line is pulled at odd angles to the channel, such as when the lane line is being extended into the pool while walking around the deck rather than swimming it straight across the pool.

A need exists for improvement in swimming pool lane line support devices. This, and other needs, are addressed by one or more aspects of the present invention.

SUMMARY OF THE INVENTION

The present invention includes many aspects and features. Moreover, while many aspects and features relate to, and are described in, the context of swimming pool accessories, the present invention is not limited to use only in swimming pool accessories, as will become apparent from the following summaries and detailed descriptions of aspects, features, and one or more embodiments of the present invention.

Accordingly, one aspect of the present invention relates to a swimming pool lane line support apparatus as substantially shown and described. An exemplary such apparatus includes a first end portion defining a first guide member, a second end portion defining a second guide member, and a central portion including a smooth, curved surface. Furthermore, in this aspect of the invention, the first guide member, second guide member and curved surface define a lane line channel adapted to support and contain a swimming pool lane line.

In a feature of this aspect, the smooth, curved surface is convex.

In another feature of this aspect, the swimming pool lane line support apparatus is adapted to securely fit in a peripheral gutter system of a swimming pool, the peripheral gutter system including an upper boundary member and a lower boundary member.

In a variation of this feature, the apparatus further includes a flat frontal bottom edge adapted to rest against the lower boundary member, a flat back edge adapted to rest against the upper boundary member, and a notched portion adapted to rest against the lower boundary member.

In a further variation of this feature, the peripheral gutter system further includes a supporting cover system. In a further feature, the supporting cover system includes a plurality of slats. In another further feature, at least a portion of the first and second end portions are adapted to rest against the supporting cover system.

In another feature of this aspect of the invention, the apparatus is constructed from wood.

In a variation of this feature, the wood is waterproof, pressure-treated wood.

In another variation of this feature, the wood is coated with a waterproof gel.

In another feature, the apparatus is comprised of formed fiberglass materials.

In still another feature, the apparatus is comprised of polyethylene.

In another feature still, the apparatus is comprised of polystyrene.

In yet another feature, the apparatus is comprised of plastic.

In yet another feature, the apparatus is comprised of metal.

In yet another feature, the apparatus is comprised of fiberglass and resin materials.

In a further feature, the apparatus is comprised of waterproof, pressure-treated wood and polyethylene.

In yet a further feature, the first end portion, the second end portion, and the central portion are integrally formed.

In still a further feature, the first end portion, the second end portion, and the central portion are each comprised of one or more separate pieces.

In a variation of this feature, the one or more separate pieces are attached using one or more connectors. In alternative variations, the connectors include screws, glue, pegs, clips, latches, clasps, hasps, and any other appropriate connection means.

In yet another feature, the curved surface is removably attachable to the central portion.

In still another feature, the curved surface is integrally formed with the central portion.

In an additional feature, the lane line channel is of a width sufficient to accommodate snaking, coiling and bunching of the swimming pool lane line as the swimming pool lane line is retracted from the pool.

In a variation of this feature, the first end portion and second end portion are of a height sufficient to further accommodate snaking, coiling and bunching of the swimming pool lane line as the swimming pool lane line is retracted from the pool.

In another variation of this feature, the first end portion and second end portion are of a height sufficient to contain the swimming pool lane line disposed therebetween while the swimming pool lane line is extended into and retracted from the pool.

Another aspect of the present invention relates to a lane line protection system, comprising a peripheral gutter system including a support apparatus as substantially shown and described. An exemplary such system includes a peripheral gutter system including a recessed gutter, an upper boundary member at a first elevation, the upper boundary member separating the recessed gutter from a pool deck, a lower boundary member at a second elevation, and the lower boundary member separating the recessed gutter from a pool, and further includes a swimming pool lane line support apparatus. Furthermore, the swimming pool lane line support apparatus is positioned adjacent the upper boundary member and the lower boundary member.

In a feature of this aspect of the invention, the peripheral gutter system includes a supporting cover system at least partially covering the recessed gutter.

In a further feature of this aspect, the supporting cover system includes a plurality of slats. In a variation of this feature, the swimming pool lane line support apparatus is integrally formed with one or more of the plurality of slats covering the recessed gutter.

In a further feature of this aspect, the swimming pool lane line support apparatus is integrally formed with the supporting cover system.

In a feature of this aspect of the invention, the swimming pool lane line support apparatus is integrally formed with at least one of the upper or lower boundary members.

In another feature, the swimming pool lane line support apparatus is adapted to be transported to, and placed at various locations within the peripheral gutter system.

In still another feature, the swimming pool lane line support apparatus includes a back edge, a bottom edge, and a frontal notched portion.

In a variation of this feature, the back edge rests against the upper boundary member, and the frontal notched portion rests against the lower boundary member.

In still another feature, the first elevation is greater than the second elevation.

In yet another feature, the swimming pool lane line support apparatus defines a channel for placement of a swimming pool lane line extending from the pool deck to the pool.

Another aspect of the present invention relates to a method of manufacturing a swimming pool lane line support apparatus as substantially shown and described.

Another aspect of the present invention relates to a method of using a swimming pool lane line support apparatus as substantially shown and described.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1A:
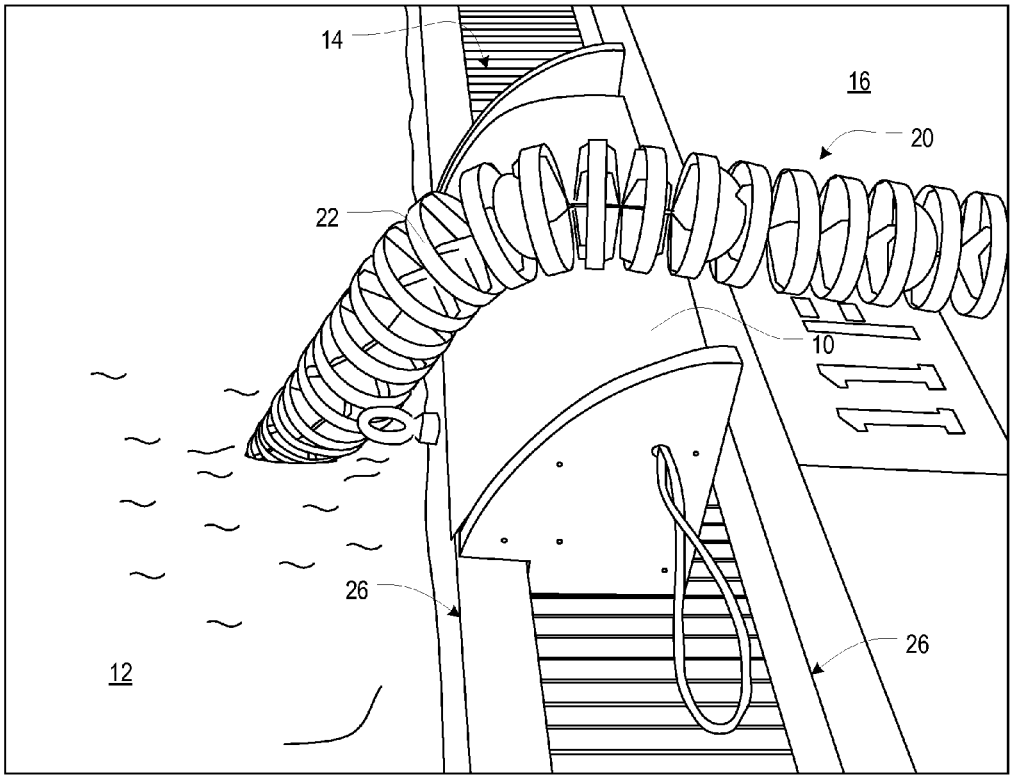
FIGS. 1A and 1B are side perspective views of a preferred embodiment of a swimming pool lane line support apparatus in accordance with one or more aspects of the present invention in a peripheral gutter system of a swimming pool and further showing a swimming pool lane line.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 1B:
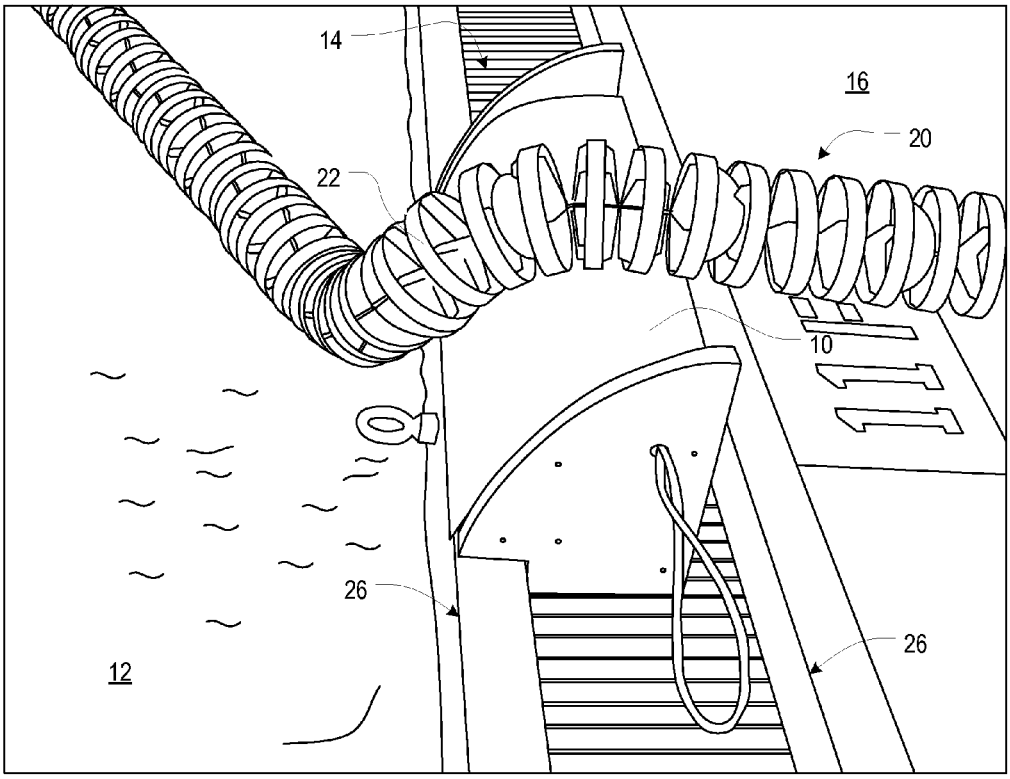

FIGS. 1A and 1B are side perspective views of a preferred embodiment of a swimming pool lane line support apparatus 10 in accordance with one or more aspects of the present invention. FIGS. 1A and 1B illustrate the lane line support apparatus 10 in use in a peripheral gutter system 14 of a swimming pool 12. FIGS. 1A and 1B further show a lane line 20 extending from the pool deck 16, over the lane line support apparatus 10, and into the pool 12. The lane line 20 may be of any design, typically comprising individual spaced-apart plastic rings or disks 22 that are threaded onto the supporting cable. Rather than, or in addition to, rings or disks, lane lines may include donut- to ovoid-shaped floats. Because the rings, disks or floats 22 are designed for buoyancy, they float, holding the supporting cable near the surface of the pool 12. The rings or disks 22, for most commercially available lane lines, have a diameter of from 3½ to 6 inches. When stored, the lane line 20 is either retracted onto the pool deck or wound onto a lane line storage reel located on the pool deck 16. When retrieved from storage, the lane line 20 must therefore be extended from the pool deck 16 or unwound from the reel. In both cases, the lane line support apparatus 10 provides a smooth surface over which the lane line 20 may glide as it transitions from the reel to the pool 12, bypassing the relatively sharp edges 26 of the peripheral gutter system 14 and pool deck 16. It will further be appreciated that the lane line support apparatus 10 is capable of supporting two or more lane lines 20 simultaneously.

Figure 2:
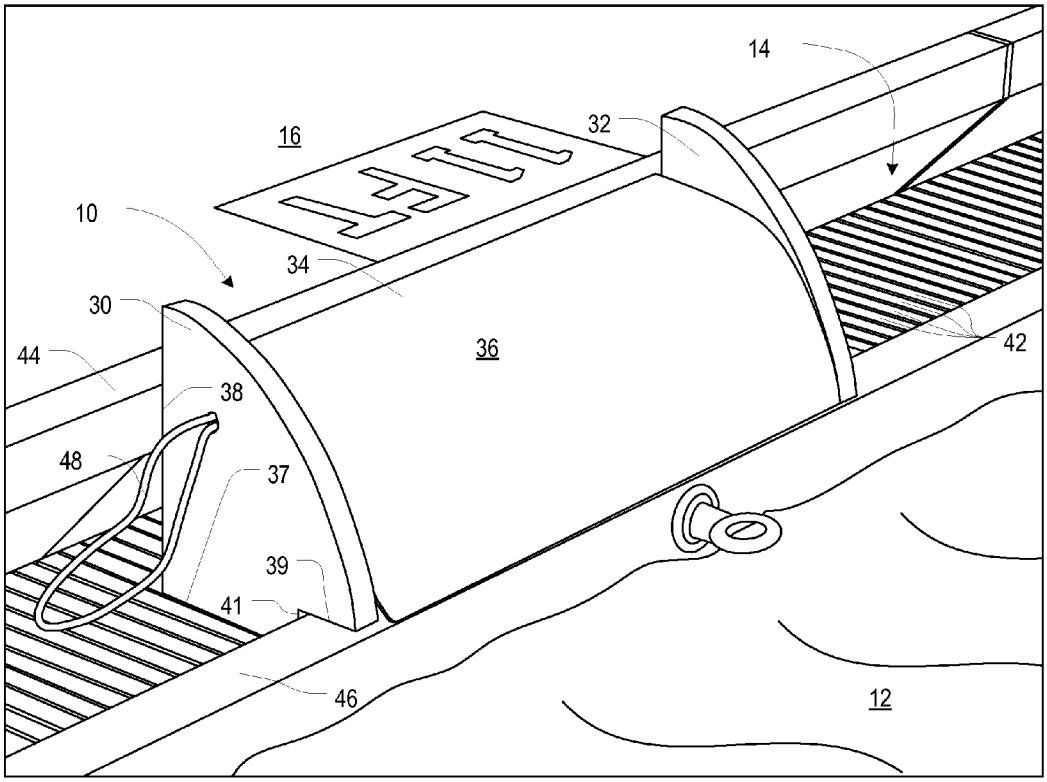
FIG. 2 is a front perspective view of the swimming pool lane line support apparatus of FIGS. 1A and 1B in a peripheral gutter system of a swimming pool.
Figure 3:
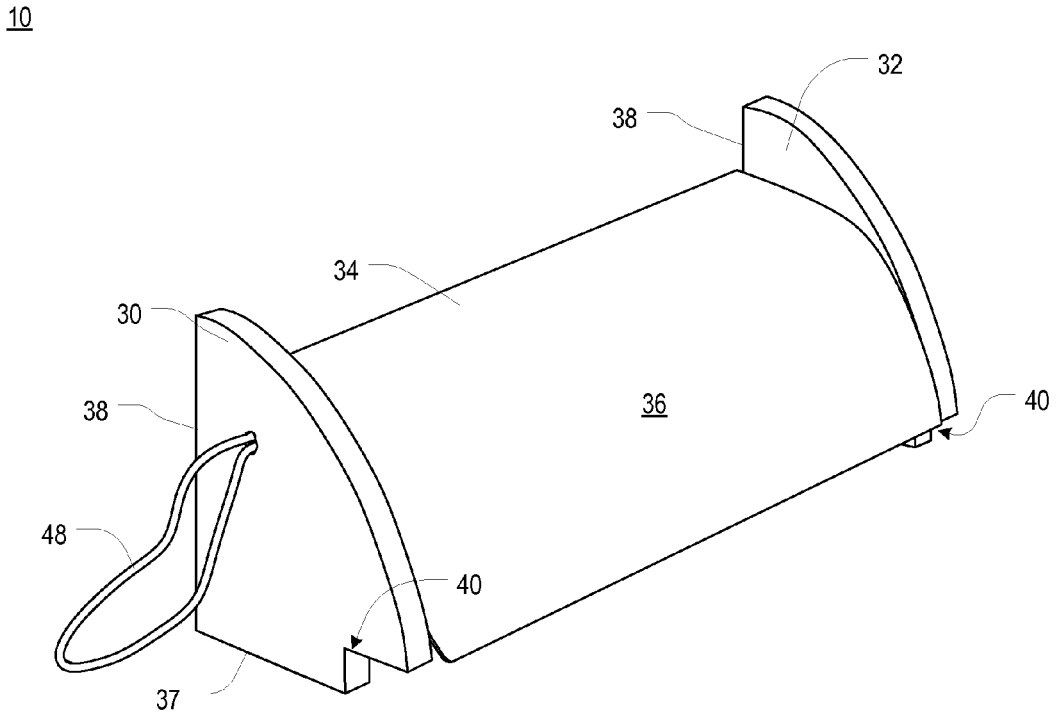
FIG. 3 is a front perspective view of the swimming pool lane line support apparatus of FIGS. 1A and 1B.
Figure 4:
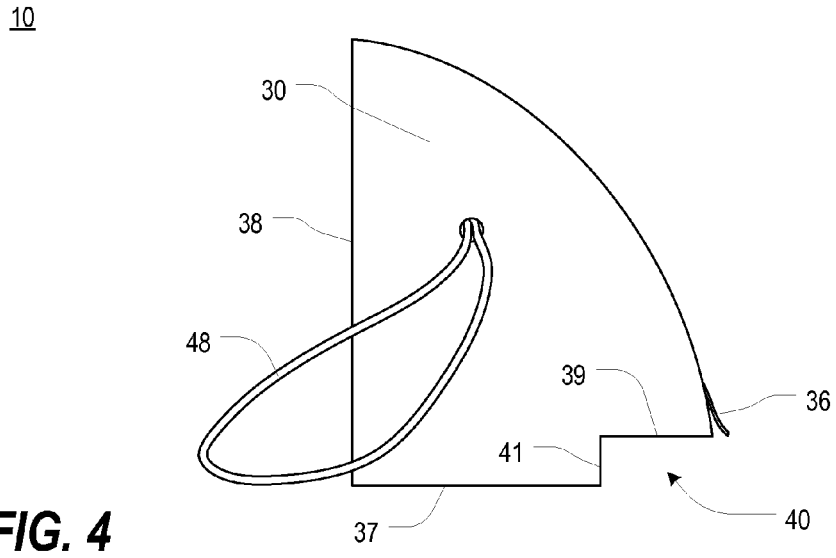
FIG. 4 is a left side view of the swimming pool lane line support apparatus of FIGS. 1A and 1B.

FIGS. 2 and 3 are front perspective views of the swimming pool lane line support apparatus 10 of FIGS. 1A and 1B. In FIG. 2, the lane line support apparatus 10 is shown placed in the peripheral gutter system 14 between the pool 12 and the pool deck 16. In FIG. 3, the lane line support apparatus 10 is shown independently of a peripheral gutter system. FIG. 4 is a left side view of the swimming pool lane line support apparatus of FIGS. 1A and 1B.

As seen in FIGS. 1A-4, the lane line support apparatus 10 comprises a first end portion 30, a second end portion 32, and a central portion 34 therebetween. The central portion 34 includes a curved surface 36 adapted to support a lane line 20. Preferably, the curved surface 36 is smooth, convex in shape and constructed from a material with a low coefficient of friction. The curved surface 36 reduces the risk of damage to the lane line 20 as it is retracted from the pool 12. In at least one preferred embodiment, the curved surface is constructed from a different material than the remainder of the central portion 34. Furthermore, in one or more preferred embodiments, the curved surface 36 is removably attachable to the central portion 34. The end portions 30,32 have a greater height than the central portion 34. The parts of the end portions 30,32 extending above the maximum height of the central portion 34 act as a guide or deflector for a lane line 20 and create a barrier defining a lane line channel adapted to accept and support a lane line 20 as perhaps best shown in FIGS. 1A and 1B.

The support apparatus 10 includes end portions 30,32 having an approximately flat bottom edge 37, an approximately flat back edge 38, and an L-shaped notch 40 formed from a leading horizontal portion 39 and a vertical portion 41. The apparatus 10 does not extend over the edge of the pool deck 16, but rather is adapted to rest securely within the peripheral gutter system 14 and provide a smooth transition from the deck 16 to the pool 12 and a smooth transition from the pool 12 to the deck 16. An exemplary such peripheral gutter system 14, as perhaps best seen in FIG. 2, includes a recessed gutter covered by a plurality of slats 42 and positioned between an upper boundary member 44 separating the peripheral gutter system 14 from the pool deck 16 and a lower boundary member 46 separating the peripheral gutter system 14 from the pool 12. The bottom edge 37 rests securely on one or more of the plurality of slats 42. The back edge 38 rests securely against the upper boundary member 44 of the peripheral gutter system 14. The leading horizontal portion 39 of the L-shaped notch 40 rests upon the top of the lower boundary member 46. Furthermore, the vertical portion 41 of the L-shaped notch 40 is adapted to rest against the gutter-facing side of the lower boundary member 46 to prevent unwanted shifting of the apparatus 10 toward the pool 12 or toward the pool deck 16.

While FIGS. 1A, 1B and 2 illustrate a peripheral gutter system that includes a plurality of slats, it will be appreciated that the swimming pool lane line support apparatus 10 does not require the presence of slats in the peripheral gutter system. For such a peripheral gutter system, the back edge 38, resting against the upper boundary member 44, and the notch 40, resting against the lower boundary member 46, provide the necessary support to hold the lane line support apparatus 10 in place. Furthermore, it will be appreciated that the gutter may be covered by some cover system other than a plurality of slats, and that such system may provide support for the apparatus 10, or be integrally formed with such apparatus 10.

The curved surface 36 of the central portion 34 has a top edge adjacent the upper boundary member 44 and a bottom edge abutting the lower boundary member 46. The curved surface 36 is positioned to eliminate the presence of any sharp edges 26 on which the rings or disks 22 of the lane line 20 could get caught. To protect the lane line 20 to the greatest possible extent, the curved surface 36 provides a gradual curve between the upper boundary member 44 and the lower boundary member 46.

In one or more preferred embodiments, as seen in FIGS. 1A, 1B and 2, the end portions 30,32 are convexly curved with one end of the curve being flush with the lower boundary member 46 and the other end of the curve extending above the upper boundary member 44. The end portions 30,32 must extend far enough above the upper boundary member 44 to contain the lane line 20 situated therein. In at least one alternative preferred embodiment, the end portions include rounded edges to further reduce the risk of the lane line 20 catching on the end portions.

It will be appreciated that the lane line channel defined by the curved surface 36 and the end portions 30,32 is of sufficient width to counteract any "snaking effect." Snaking is caused as the lane line 20 is being removed from the pool 12. As the lane line 20 is being retracted, the portion of the lane line 20 remaining in the pool 12 will not remain in a straight line, but rather will begin to coil, bunch, and/or drift to the right and left. This can lead to tangling of the lane line 20 and increased difficulty in reeling in the lane line 20. The lane line support apparatus 10 includes a channel sufficiently wide enough to accommodate snaking, coiling and bunching of the lane line 20 as it is wound for storage. In one or more preferred embodiments, the width of the channel is greater than four times the diameter of the lane line 20 and less than six times the diameter of the lane line 20. In one preferred embodiment the width of the channel is approximately five times the diameter of the lane line 20.

It will further be appreciated that the end portions 30,32 provide support to the lane line as it is being extended into the pool from a side angle. End portions 30,32 with greater relative height to the central portion 34 will further reduce snaking, coiling and bunching of the lane line 20 as it is removed from the pool 12. In one or more preferred embodiments, the distance between the top of the central portion 34 and the top of an end portions 30,32 is between 100% and 130% of the diameter of the lane line 20. For example, a lane line having a four inch diameter is best contained by end portions 30,32 extending approximately five-inches above the top of the central portion 34.

In at least some embodiments, the apparatus 10 is removable and transportable. To facilitate this, and as seen in FIGS. 1A-4, the lane line support apparatus 10 includes one or more handles 48 extending from holes in the end portions 30,32 allowing for the apparatus 10 to be easily picked up and transported. The handles 48 are comprised of a looped segment of rope which a user can grasp to more easily carry the lane line support apparatus 10. Alternative embodiments of the lane line support apparatus may include other suitable hand-hold features. Furthermore, additional embodiments may not include handles, as seen in swimming pool lane line support apparatus 110 discussed hereinbelow. When hand hold features are present, it is contemplated that the apparatus 10 may be transported to various locations in the peripheral gutter system 14. Alternatively, multiple apparatuses 10 may be used at the various locations around the peripheral gutter system 14.

Because the swimming pool lane line support apparatus 10 is designed to fit a peripheral gutter system 14, it will be appreciated that the swimming pool lane line support apparatus 10 is capable of being manufactured in a range of dimensions corresponding to the dimensions of various peripheral gutter systems. In at least one preferred embodiment, the end portions 30,32 are ½-inch (½") wide, the back edge 38 is 10-inches (10") in height, the bottom edge 37 is 5-inches (5") in length, and the notch 40 is 1-inch (1") in height and 2¼-inches (2¼") in length. Furthermore, the central portion 34 is 7-inches (7") in height and 20-inches (20") wide.

In one or more preferred embodiments, a swimming pool lane line support apparatus in accordance with one or more aspects of the present invention may be constructed from various materials including polyethylene, polystyrene, fiberglass, waterproof, pressure-treated wood, other waterproof wood-like materials, metals, or various plastics and other synthetic materials. In at least one preferred embodiment, the lane line support apparatus is constructed by assembling multiple pieces. For instance, in one preferred embodiment, the end portions, made of waterproof, pressure-treated wood, are attached to a central portion, also made of waterproof, pressure-treated wood, using stainless steel screws. The entire framework is then coated with a polyester gel coat, commonly used in fiber glass applications, to add further waterproofing protection. Thereafter, a curved surface of polyethylene is affixed to the top and front exterior surface of the central portion with stainless steel screws. In at least one alternative preferred embodiment, the lane line support apparatus is constructed from a singly formed waterproof material such as blow-molding or fiberglass molding. In one or more alternative embodiments, an apparatus in accordance with one or more aspects of the present invention is manufactured through a blow molding process or a fiberglass molding process.

It is further contemplated, that in one or more embodiments, a swimming pool lane line support apparatus is integrally formed with a swimming pool peripheral gutter system 14. Such a lane line support apparatus may be molded to the gutter system 14 along the edge of the pool 12 or comprise a hinged or connected portion of/within a gutter system 14. It is even further contemplated that such a gutter system may include more than one integrally formed lane line support apparatus. It is still further contemplated that a swimming pool lane line support apparatus is adapted to form at least a portion of a cover for a recessed gutter.

Figure 5A:
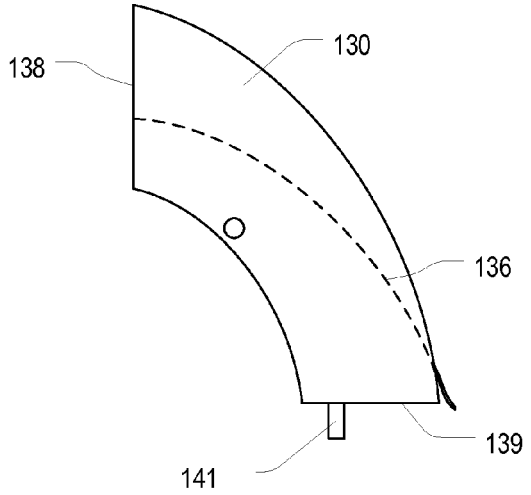
FIG. 5A is a side view of a swimming pool lane line support apparatus in accordance with one or more aspects of the present invention.
Figure 5B:
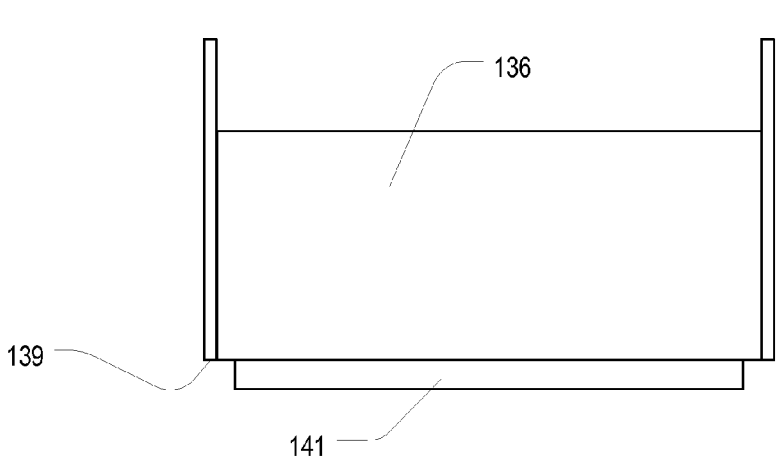
FIG. 5B is a front view of the swimming pool lane line support apparatus of FIG. 5A.
Figure 5C:
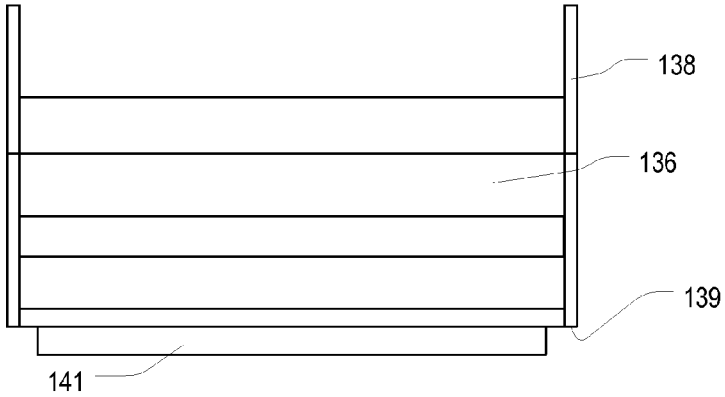
FIG. 5C is a rear view of the swimming pool lane line support apparatus of FIG. 5A.

FIG. 5A is a side view of a preferred embodiment of a swimming pool lane line support apparatus 110 in accordance with one or more aspects of the present invention. FIG. 5B is a front view of the apparatus 110 of FIG. 5A. FIG. 5C is a rear view of the apparatus 110 of FIG. 5A. The lane line support apparatus 110 as seen in FIGS. 5A-5C is similar to the apparatus 10 previous described. The apparatus 110 is adapted to operate within a peripheral gutter system 14, and includes a curved surface 136 and an end portion 130 having a flat back edge 138. However, in contrast to the apparatus 10, the apparatus 110 includes an end portion 130 with less surface area and a smaller bottom edge 139, the bottom edge 139 being adapted to rest upon the top surface of the lower boundary member 46. Also, the end portion 130 does not include a vertical portion. Rather, the central portion of the apparatus 110 includes a downward extending member 141 adapted to abut the gutter-facing side of the lower boundary member 46, thus preventing unwanted shifting of the apparatus 110 toward the pool 12 or toward the pool deck 16.

Figure 6A:
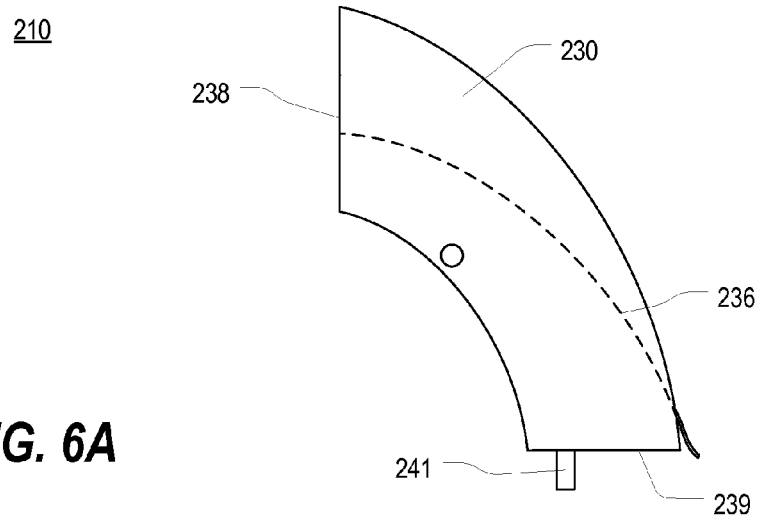
FIG. 6A is a side view of a swimming pool lane line support apparatus in accordance with one or more aspects of the present invention.
Figure 6B:
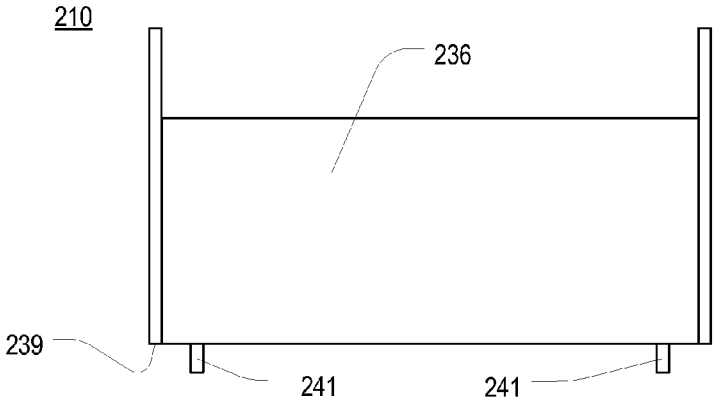
FIG. 6B is a front view of the swimming pool lane line support apparatus of FIG. 6A.
Figure 6C:
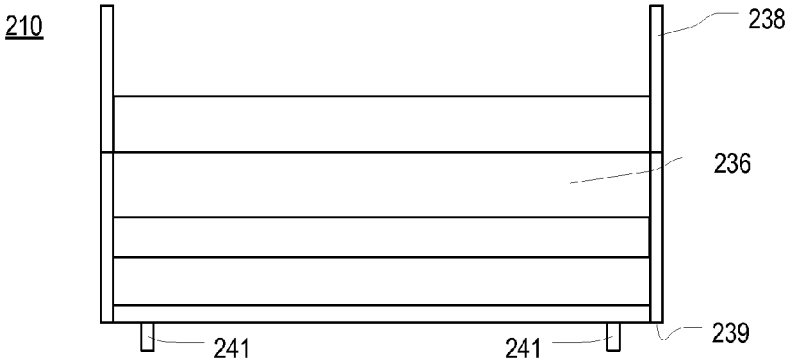
FIG. 6C is a rear view of the swimming pool lane line support apparatus of FIG. 6A.

FIG. 6A is a side view of a preferred embodiment of a swimming pool lane line support apparatus 210 in accordance with one or more aspects of the present invention. FIG. 6B is a front view of the lane line support apparatus 210 of FIG. 6A. FIG. 6C is a rear view of the lane line support apparatus 210 of FIG. 6A. The apparatus 210, seen in FIG. 6A-6C, is similar to the apparatus 110 previously described. The apparatus 210 is adapted to operate within a peripheral gutter system 14, and includes a curved surface 236 and an end portion 230 having a flat back edge 238. Also similar to the apparatus 110, the lane line support apparatus 210 includes an end portion 230 with reduced surface area and a shorter bottom edge 239, the bottom edge 239 being adapted to rest upon the top surface of the lower boundary member 46. Similar to the end portion 130, the end portion 230 does not include a vertical portion. Rather, the central portion of the lane line support apparatus 210 includes one or more downward extending members 241 adapted to abut the gutter-facing side of the lower boundary member 46, thus preventing unwanted shifting of the apparatus 210 toward the pool 12 or toward the pool deck 16.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A swimming pool lane line support apparatus, comprising:

(a) a first end portion, defining a first guide member;

(b) a second end portion, defining a second guide member; and (c) a central portion including a smooth, convex curved surface;

(d) wherein the first guide member, second guide member and curved surface define a lane line channel adapted to support and contain a swimming pool lane line;

(e) wherein the swimming pool lane line support apparatus is adapted to securely fit in a peripheral gutter system of a swimming pool, the peripheral gutter system including an upper boundary member and a lower boundary member.

2. The swimming pool lane line support apparatus of claim 1, further comprising:

(a) a flat frontal bottom edge adapted to rest against the lower boundary member;

(b) a flat back edge adapted to rest against the upper boundary member; and (c) a notched portion adapted to rest against the lower boundary member.

3. The swimming pool lane line support apparatus of claim 2, wherein the peripheral gutter system further comprises a supporting cover system.

4. The swimming pool lane line support apparatus of claim 3, wherein the supporting cover system includes a plurality of slats.

5. The swimming pool lane line support apparatus of claim 3, wherein at least a portion of the first and second end portions are adapted to rest against the supporting cover system.

6. The swimming pool lane line support apparatus of claim 1, wherein the first end portion, the second end portion, and the central portion are integrally formed.

7. The swimming pool lane line support apparatus of claim 1, wherein the first end portion, the second end portion, and the central portion are each comprised of one or more separate pieces.

8. The swimming pool lane line support apparatus of claim 7, wherein the one or more separate pieces are attached using one or more connectors.

9. The swimming pool lane line support apparatus of claim 1, wherein the curved surface is removably attachable to the central portion.

10. The swimming pool lane line support apparatus of claim 1, wherein the curved surface is integrally formed with the central portion.

11. The swimming pool lane line support apparatus of claim 1, wherein the lane line channel is of a width sufficient to accommodate snaking, coiling and bunching of the swimming pool lane line as the swimming pool lane line is retracted from a pool.

12. The swimming pool lane line support apparatus of claim 11, wherein the first end portion and second end portion are of a height sufficient to further accommodate snaking, coiling and bunching as the swimming pool lane line is retracted from the pool.

13. The swimming pool lane line support apparatus of claim 11, wherein the first end portion and second end portion are of a height sufficient to contain the swimming pool lane line disposed therebetween while the swimming pool lane line is extended into and retracted from the pool.

14. A lane line protection system, comprising:

(a) a peripheral gutter system, comprising:

(i) a recessed gutter;

(ii) an upper boundary member at a first elevation, the upper boundary member separating the recessed gutter from a pool deck; and (iii) a lower boundary member at a second elevation, the lower boundary member separating the recessed gutter from a pool; and (b) a swimming pool lane line support apparatus;

(c) wherein the swimming pool lane line support apparatus is positioned adjacent to the upper boundary member and the lower boundary member.

15. The lane line protection system of claim 14, wherein the peripheral gutter system includes a supporting cover system at least partially covering the recessed gutter.

16. The lane line protection system of claim 15, wherein the supporting cover system includes a plurality of slats.

17. The lane line protection system of claim 16, wherein the swimming pool lane line support apparatus is integrally formed with one or more of the plurality of slats covering the recessed gutter.

18. The lane line protection systems of claim 15, wherein the swimming pool lane line support apparatus is integrally formed with the supporting cover system.

19. The lane line protection system of claim 14, wherein the swimming pool lane line support apparatus is integrally formed with at least one of the upper boundary member or the lower boundary member.

20. The lane line protection system of claim 14, wherein the swimming pool lane line support apparatus is adapted to be transported to, and placed at, various locations of the peripheral gutter system.

21. The lane line protection system of claim 14, wherein the swimming pool lane line support apparatus includes a back edge, a bottom edge, and a frontal notched portion.

22. The lane line protection system of claim 21, wherein the back edge rests against the upper boundary member and the frontal notched portion rests against the lower boundary member.

23. The lane line protection system of claim 14, wherein the first elevation is greater than the second elevation.

24. The lane line protection system of claim 14, wherein the swimming pool lane line support apparatus defines a channel for placement of a swimming pool lane line extending from the pool deck to the pool.

* * * * *